US005384557A

United States Patent [19]

Yoshida et al.

[11] Patent Number: 5,384,557

[45] Date of Patent: Jan. 24, 1995

[54] POLARIZATION SEPARATOR AND WAVEGUIDE-MICROSTRIP LINE MODE TRANSFORMER FOR MICROWAVE APPARATUS

[75] Inventors: Yoshikazu Yoshida, Tokyo; Kenichi Kawasaki, Kanagawa; Shozo Horisawa, Chiba; Hiroyuki Mita, Kanagawa; Keiji Fukuzawa, Chiba, all of Japan

[73] Assignee: Sony Corporation, Tokyo, Japan

[21] Appl. No.: 150,622

[22] Filed: Nov. 10, 1993

[30] Foreign Application Priority Data

| | | | |
|---|---|---|---|
| Nov. 10, 1992 | [JP] | Japan | 4-323732 |
| Nov. 13, 1992 | [JP] | Japan | 4-327549 |
| Mar. 11, 1993 | [JP] | Japan | 5-076403 |

[51] Int. Cl.[6] ..... H01P 1/16

[52] U.S. Cl. ..... 333/21 A; 333/137; 333/126

[58] Field of Search ..... 333/21 A, 137, 136, 333/125, 126, 129

[56] References Cited

U.S. PATENT DOCUMENTS

| | | | |
|---|---|---|---|
| 2,877,429 | 3/1959 | Sommers et al. . | |
| 4,596,047 | 6/1986 | Watanabe et al. | 333/21 A |
| 4,816,786 | 3/1989 | Möhring et al. | 333/21 A |
| 4,821,046 | 4/1989 | Wilkes | 333/21 A |
| 4,837,531 | 6/1989 | Gourlain et al. | 333/21 A |

FOREIGN PATENT DOCUMENTS

| | | | |
|---|---|---|---|
| 0249310 | 12/1987 | European Pat. Off. . | |
| 0552944 | 7/1993 | European Pat. Off. . | |
| 3111106 | 9/1982 | Germany . | |
| 0067301 | 4/1982 | Japan | 333/21 A |
| 57-067301 | 4/1982 | Japan . | |
| 0210702 | 3/1985 | Japan . | |
| 61-052001 | 3/1986 | Japan . | |
| 0052002 | 3/1986 | Japan | 333/137 |
| 61-102802 | 5/1986 | Japan . | |
| 01027301 | 1/1989 | Japan . | |
| 01138801 | 5/1989 | Japan . | |
| 4134901 | 5/1992 | Japan | 33/21 A |

OTHER PUBLICATIONS

"Integrated Input Circuit For Satellite Converter", J. Modelski et al. Sep. 4–7, 1989, 19th European Microwave Conference–Proceedings.

*Primary Examiner*—Robert J. Pascal
*Assistant Examiner*—Darius Gambino
*Attorney, Agent, or Firm*—Lise A. Rode; Jerry A. Miller; Robert P. Biddle

[57] ABSTRACT

A polarization separator for separating orthogonal polarization waves into a horizontal polarization wave component and a vertical polarization wave component is minimized in size. A metal pole in the form of a thin metal bar is disposed in a circular waveguide of a waveguide member into which the orthogonal polarization waves are introduced, and reflects the horizontal polarization wave component so that it is outputted through an output terminal formed in a circumferential wall of the waveguide member. Meanwhile, the vertical polarization wave component propagates in a substantially rectangular waveguide provided rearwardly of the metal pole and is outputted from another output terminal. Since the rectangular waveguide is formed in a cutoff structure for the horizontal polarization wave component, the reflection means can be formed from the metal pole in the form of a thin bar, and consequently, the polarization separator can be minimized.

5 Claims, 16 Drawing Sheets

POLARIZATION SEPARATOR AND WAVEGUIDE-MICROSTRIP LINE MODE TRANSFORMER FOR MICROWAVE APPARATUS

BACKGROUND OF THE INVENTION

1. Field of the Invention

This invention relates to a polarization separator which separates orthogonal polarization electromagnetic waves propagating in a circular waveguide into a horizontal polarization wave and a vertical polarization wave, and more particularly to a polarization separator for use with a reception antenna or a like apparatus for broadcasting such as CS (Communication Satellite) broadcasting in Japan or ASTRA satellite broadcasting in Europe wherein horizontal polarization waves and vertical polarization waves are transmitted as orthogonal polarization waves modulated in various channels.

The present invention further relates to a converter integrated with a polarization separator suitable to receive broadcasting of the type mentioned and an output waveguide-microstrip line mode transformer for a polarization separator for use with the converter.

2. Description of the Related Art

Various broadcast waves are transmitted from artificial satellites floating at the height of 36,000 Km from the ground. Of such broadcast waves, CS broadcast waves for commercial use can be received in Japan in addition to BS (Broadcasting Satellite) broadcast waves for use for television broadcasting.

A broadcasting frequency band of microwaves or quasi millimeter waves (SHF) is utilized for such broadcast waves. The broadcast waves are received by means of a parabola antenna normally installed on the roof, converted into predetermined frequencies by a converter and inputted to a tuner by which a broadcasting channel is selected.

A parabola antenna for receiving orthogonal polarization waves of the CS broadcasting or the ASTRA satellite broadcasting from among various broadcast waves is typically constructed in such a manner as shown in FIG. 8. Referring to FIG. 8, the parabola antenna shown includes a parabola reflector 81 for reflecting and converging radio waves from a satellite, a primary horn 83 for receiving the thus converged radio waves, a polarization separator 1 for separating the orthogonal polarization radio waves received by the primary horn 83 into horizontal polarization waves and vertical polarization waves, and a down converter 84 for converting the horizontal polarization waves and the vertical polarization waves separated by the polarization separator 1 for individual channels by frequency conversion and supplying signals obtained by the frequency conversion to a television tuner not shown.

Various polarization separators are conventionally employed for the polarization separator 1 in such an antenna for receiving the CS broadcasting as shown in FIG. 8 or a parabola antenna for receiving the ASTRA broadcasting. An exemplary one of such conventional polarization separators is shown in FIGS. 1 and 2A to 2C. FIG. 1 is a perspective view of the conventional polarization separator, and FIGS. 2A to 2C are a front elevational view, a longitudinal sectional view and a top plan view, respectively, of the conventional polarization separator.

Referring first to FIG. 1, the polarization separator shown includes a substantially tubular member 1 and separates orthogonal polarization waves received by a CS broadcasting reception antenna or an ASTRA broadcasting reception antenna into a horizontal polarization wave component H and a vertical polarization wave component V. The tubular member 1 has a circular waveguide 4 formed therein for propagating the orthogonal polarization waves therein. The circular waveguide 4 has a flange 2 to which the primary horn 83 shown in FIG. 8 is securely connected. A plurality of through-holes 3 are formed in the flange 2, and bolts not shown for securing the primary horn 83 shown in FIG. 8 are fitted in the through-holes 3. The tubular member 1 further has a rectangular opening 5 formed therein. The rectangular opening 5 has a major side in the direction of an axis of the circular waveguide 4 and serves as a horizontal polarization wave output terminal from which the separated horizontal polarization wave component H is extracted. A reflection plate 6 is located in the inside of the circular waveguide 4 and reflects only the horizontal polarization wave component H. The tubular member 1 further has a vertical polarization output terminal 7 from which the vertical polarization wave component V is extracted.

Orthogonal polarization waves received by the CS broadcasting reception antenna or ASTRA broadcasting reception antenna are introduced in the directions of orthogonal arrow marks V and H shown in FIG. 1 into the tubular member 1 of the polarization separator by way of the primary horn 83.

When the orthogonal polarization waves propagate in the circular waveguide 4 and reach the reflection plate 6 as indicated by arrow marks in FIG. 1, the horizontal polarization wave component H of the orthogonal polarization waves is reflected by the reflection plate 6 placed horizontally in the circular waveguide 4 so that it is outputted as indicated by an arrow mark H in FIG. 1 from the output terminal 5 in the form of a rectangular opening having a major side in the direction of the axis of the circular waveguide 4.

Meanwhile, the vertical polarization wave component V of the orthogonal polarization waves is not reflected by the reflection plate 6 since it is orthogonal to the reflection plate 6. Consequently, the vertical polarization wave component V propagates straightforwardly in the circular waveguide 4 and is outputted as indicated by an arrow mark V in FIG. 1 from the output terminal 7 of the circular waveguide 4.

It is to be noted that, since the output terminal 5 in the form of a rectangular opening has a cutoff structure (this will be hereinafter described) as viewed from the vertical polarization wave component V, the vertical polarization wave component V is not outputted from the output terminal 5.

As can be recognized from the structure described above, the conventional polarization separator separates orthogonal polarization waves into a horizontal polarization wave component H and a vertical polarization wave component V while the orthogonal polarization waves propagate in the polarization separator.

Further, in the polarization separator, propagation of the horizontal polarization wave component H toward the output terminal 7 is prevented by the reflection plate 6 which reflects the horizontal polarization wave component H in principle. Therefore, in order to sufficiently suppress the horizontal polarization wave component H from leaking to the output terminal 7 to assure a high separation efficiency of the polarization separator, the reflection plate 6 is formed long so as to increase the reflection efficiency of it.

FIG. 17 generally shows in perspective view an exemplary one of conventional down converters for converting radio waves received by a parabola antenna into a predetermined frequency by down conversion. Referring to FIG. 17, the down converter shown includes a waveguide member 110 having a waveguide entrance located at a focal position of a parabola antenna not shown, and a shield case 111 in which the waveguide 110 is accommodated integrally.

A waveguide-microstrip mode transformer section 112 which will be hereinafter described is incorporated in the inside of the shield case 111. A broadcasting signal extracted from the transformer section 112 is converted into a signal of a predetermined intermediate frequency by a microwave integrated circuit (MIC) provided on a circuit board 113 made of Teflon or a like material and is then connected to a tuner by way of a connector not shown.

Such a pair of signal circuits for converting a channel frequency of a horizontal polarization wave $S_H$ and a vertical polarization wave $S_V$ as shown in FIG. 18 are located on the circuit board 113, and each of the signal circuits includes a low noise radio frequency amplifier (RF amplifier), a local oscillator (OSC), a mixer (MIX) and an intermediate frequency amplifier (IF/AMP). The signal circuits and function circuits which include a stabilized power source section and so forth are disposed on a wiring pattern constructed as a distributed constant circuit on the circuit board 113.

Thus, the converter is constructed such that it separates received radio waves into horizontal polarization waves and vertical polarization waves in the waveguide of the waveguide member, processes thus separated signals $S_H$ and $S_V$ by the two respective signal circuits to obtain two intermediate frequency outputs IF1 and IF2 and supplies the intermediate frequency outputs IF1 and IF2 to a tuner on the reception side by way of a cable.

As well known in the art, two dc voltages DC1 and DC2 for driving the converter are supplied from the tuner side to the stabilized power source and supply power to the stabilized power source section each by way of a coil L and a diode D.

FIGS. 19A and 19B show a sectional view and a top plan view of the transformer section 112 from which electromagnetic waves having propagated in the waveguide 110 are extracted by means of a microstrip line.

Referring to FIGS. 19A and 19B, a central conductor 113A of a microstrip line printed on the circuit board 113 is partially inserted by a predetermined length as a probe in an internal space 112A of the transformer section 112 through an opening 112B formed in the transformer section 112. A grounding conductor (grounding conductor on the rear face of the circuit board 113) 113B constitutes the microstrip line and is removed at a portion 113D thereof in the inside of the waveguide 110 (transformer section 112).

The conventional polarization separator is disadvantageous in that, since the reflection plate 6 in the circular waveguide 4 must necessarily have a great length so as to assure a high separation efficiency, the circular waveguide 4 has a great length particularly in the axial direction, and this makes it difficult to minimize the entire polarization separator 1.

Further, though not shown, since a rectangular waveguide member is connected to the outside of the rectangular output terminal 5 of the tubular member 1, the opening of the output terminal 5 must have a sufficiently great size. Since the opening has a great size, the electromagnetic field in the circular waveguide 4 adjacent the opening is disordered in distribution, and this results in production of a reflection wave to return to the input terminal of the circular waveguide or in leakage of orthogonal polarization waves between the output terminals 5 and 7. Accordingly, there is a problem in that it is difficult to assure a high separation efficiency of the polarization separator.

Furthermore, since the polarization separator and the converter are coupled to each other at an end portion of the polarization separator adjacent the output waveguide member, there is another problem in that they are complicated in structure and great in number of parts and requires much time to produce and assemble them.

By the way, if the circuit board 113 in the converter is formed as a multi-layer circuit board, then the entire converter can be reduced in size and the mounting density of MIC (microwave integrated circuit) parts installed on the circuit boards can be increased and besides the conversion gains of signals can be enhanced.

FIG. 20 shows a sectional view where a two-layer circuit board is used to construct a waveguide-microstrip line mode transformer section, and in FIG. 20, like elements to those of FIG. 19 are denoted by like reference characters.

Referring to FIG. 20, a multi-layer circuit board assembly is composed of a circuit board 113 made of Teflon and another circuit board 114 made of glass, an epoxy resin or a like material and is inserted in an opening 112B at an end face of a waveguide member 112. A grounding conductor portion of the multi-layer circuit board assembly is removed so that electromagnetic waves in the inside of the waveguide member 112 are extracted from a center conductor 113A of a microstrip line formed on the circuit board 113. In this instance, there is a problem in that electromagnetic waves leak to the outside from a joining location between the second circuit board 114 and a portion of the waveguide member 112.

It is to be noted that the grounding conductor 113B has a thickness of 70 $\mu$m, and it is difficult to scrape off only the second circuit board layer 114 leaving the grounding conductor 113B to obtain such a structure as shown in FIG. 19.

SUMMARY OF THE INVENTION

It is an object of the present invention to provide a polarization separator which is reduced in length without deteriorating the separation efficiency to achieve minimization and reduction in cost.

It is another object of the present invention to provide a polarization separator wherein possible disorder of the distribution of an electromagnetic field in the proximity of an opening of the polarization separator at an output terminal of a polarization wave component reflected by reflection means is suppressed to allow impedance matching at the output terminal to be established readily to enhance the separation efficiency.

It is a further object of the present invention to provide a polarization separator which is formed as a unitary member together with a converter to facilitate production and assembly of the polarization separator and the converter.

It is a still further object of the present invention to provide a polarization separator which prevents electromagnetic waves from leaking to the outside through a joining location between a second circuit board of a multi-layer circuit board assembly and a waveguide member.

In order to attain the objects described above, according to an aspect of the present invention, there is provided a polarization separator for a microwave apparatus, which comprises a substantially tubular member having a circular waveguide formed therein for receiving input orthogonal polarization electromagnetic waves, a first rectangular hole formed in a side wall thereof, a second rectangular hole formed in a portion thereof remote from the portion at which the input orthogonal polarization electromagnetic waves are received, and a rectangular waveguide formed therein and extending between the circular waveguide and the second rectangular hole, and a reflecting pole located in the circular waveguide and having an axis extending perpendicularly to a direction in which the input orthogonal polarization electromagnetic waves propagate and also to a direction of a line along which the first rectangular hole and the center of the circular waveguide lie.

With the polarization separator for a microwave apparatus, since reflection means for reflecting one of input orthogonal polarization waves is formed from the reflecting pole which may be in the form of a metal bar or rod such as, for example, a machine screw, the polarization separator can be produced with a minimized size and at a reduced cost.

According to another aspect of the present invention, there is provided a polarization separator for a microwave apparatus, which comprises a substantially tubular member having a circular waveguide formed therein for receiving input orthogonal polarization electromagnetic waves, a first rectangular hole formed in a side wall thereof, a second rectangular hole formed in a same plane in the same side wall thereof, and a rectangular waveguide formed therein and extending between the circular waveguide and the second rectangular hole, and a reflecting pole located in the circular waveguide and having an axis extending perpendicularly to a direction in which the input orthogonal polarization electromagnetic waves propagate and also to a direction of a line along which the first rectangular hole and the center of the circular waveguide lie.

Also with the polarization separator for a microwave apparatus, since reflection means for reflecting one of input orthogonal polarization waves is formed from the reflecting pole which may be in the form of a metal bar or rod such as, for example, a machine screw, the polarization separator can be produced with a minimized size and at a reduced cost.

Preferably, dimensions of height and width of the rectangular waveguide are determined such that the rectangular waveguide has a cutoff frequency higher than that of a first one of the input orthogonal polarization electromagnetic waves but lower than that of a second one of the input orthogonal polarization electromagnetic waves. In this instance, preferably the polarization separator for a microwave apparatus further comprises an iris fitted in at least one of the first and second rectangular holes and having an opening formed therein, the opening of the iris being smaller than the first and/or second rectangular holes. Since the iris suppresses otherwise possible disorder of the distribution of an electric field of a vertical polarization wave component, leakage of an undesired polarization wave component can be prevented, and consequently, a high separation efficiency of the polarization separator can be assured.

According to a further aspect of the present invention, there is provided a microwave apparatus, which comprises a substantially tubular member having a circular waveguide formed therein for receiving input orthogonal polarization electromagnetic waves, a first rectangular hole formed in a side wall thereof, a second rectangular hole formed in a same plane in the same side wall thereof, and a rectangular waveguide formed therein and extending between the circular waveguide and the second rectangular hole, a reflecting pole located in the circular waveguide and having an axis extending perpendicularly to a direction in which the input orthogonal polarization electromagnetic waves propagate and also to a direction of a line along which the first rectangular hole and the center of the circular waveguide lie, the tubular member and the reflecting pole constituting a polarization separator, a circuit board, a pair of waveguide-microstrip line mode transformers located on the circuit board corresponding to locations of the first and second rectangular holes, and a cover for covering over the first and second rectangular holes and holding the circuit board thereon.

With the microwave apparatus, since the polarization separator is formed as a unitary member together with a converter which is constituted from the circuit board, waveguide-microstrip line mode transformers and cover, the microwave apparatus can be produced and assembled readily.

According to a still further aspect of the present invention, there is provided a waveguide-microstrip line mode transformer for a microwave apparatus, which comprises a circuit board, a microstrip line located on a first face of the circuit board, a probe connected to the microstrip line, a grounding pattern formed on the circuit board in such a manner as to surround the probe, a grounding layer located on a second face of the circuit board opposite to the first face, and a plurality of through-holes formed in the circuit board for electrically connecting the grounding pattern to the grounding layer.

According to a yet further aspect of the present invention, there is provided a waveguide-microstrip line mode transformer for a microwave apparatus, which comprises a circuit board, a microstrip line located on a first face of the circuit board, a probe connected to the microstrip line, a grounding pattern formed on the circuit board in such a manner as to surround the probe, a grounding layer located on a second face of the circuit board opposite to the first face, and a metal film for covering an edge of the circuit board in the inside of a portion of an element of the microwave apparatus, the circuit board including a plurality of layers each in the form of a circuit board.

With both of the waveguide-microstrip line mode transformers, even if the circuit board on which the microstrip line is formed as a multi-layer circuit board, otherwise possible leakage of electromagnetic waves from the transformer portion to the outside, which makes an obstacle to another antenna, can be prevented by means of the through-holes or the metal film. Further, a high transformation efficiency can be achieved by any of the waveguide-microstrip line mode transformers, and accordingly, when it is used for a converter, it can achieve a high overall transformation gain of the converter.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
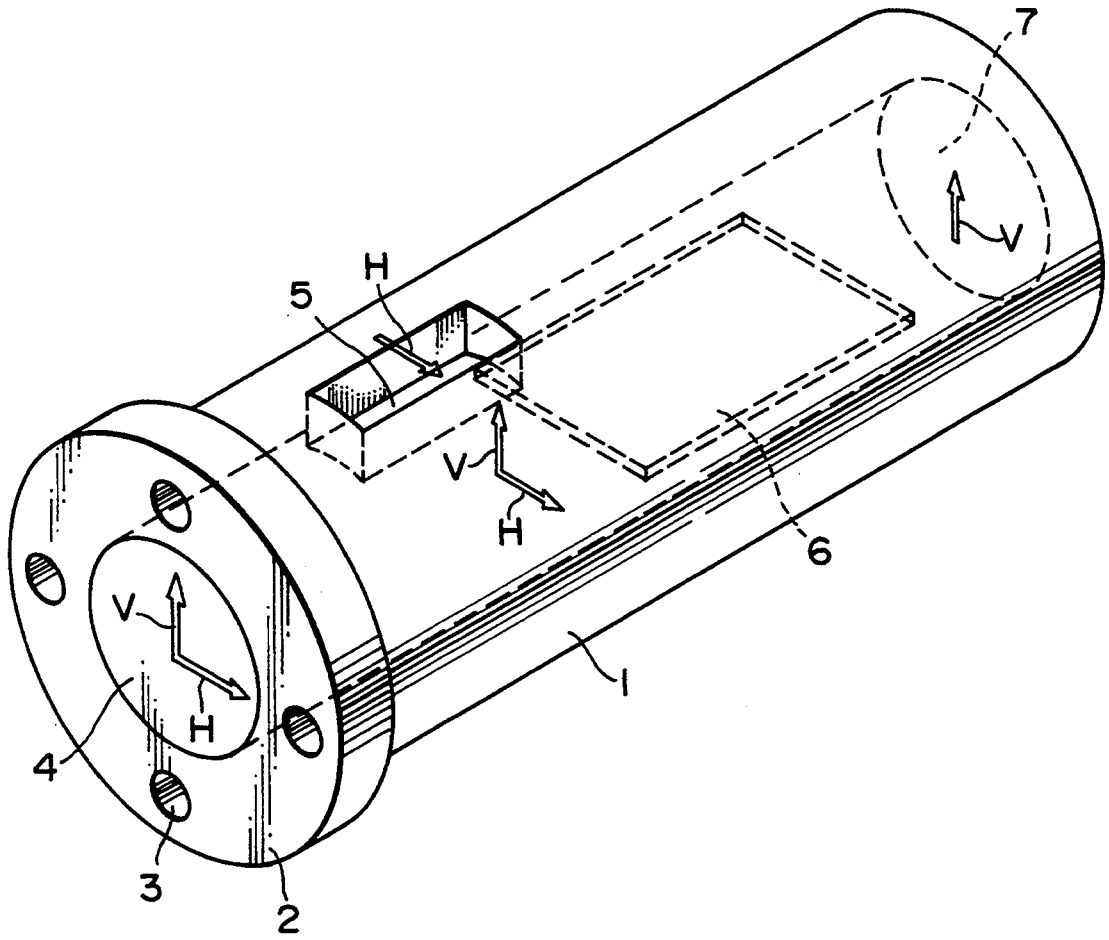
FIG. 1 PRIOR ART
FIG. 1 is a perspective view of a conventional polarization separator.
Figure 2B:
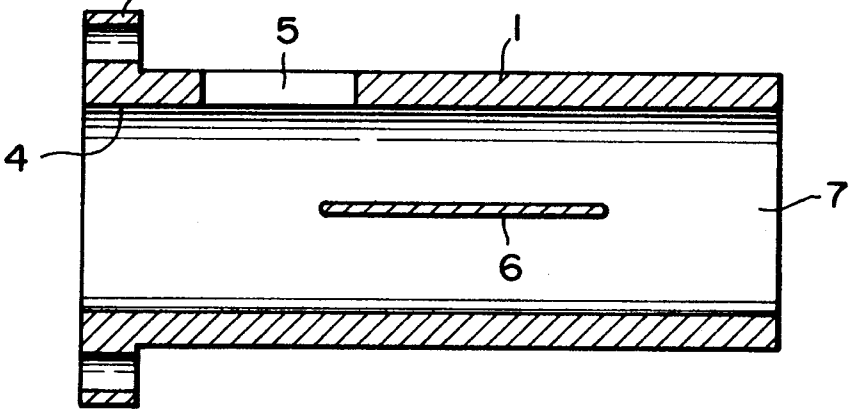
FIG.2B PRIOR ART
FIGS. 2A, 2B and 2C are a front elevational view, a side elevational sectional view and a top plan view, respectively, of the polarization separator shown in FIG. 1.
Figure 2C:
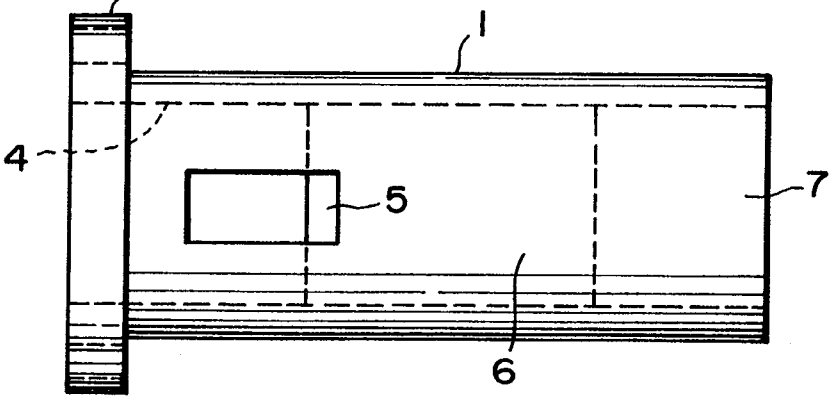
FIG.2C PRIOR ART
Figure 2A:
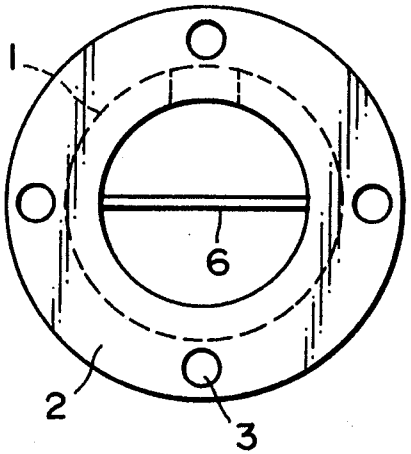
FIG.2A PRIOR ART

Referring first to FIGS. 3 and 4A to 4D, there is shown a polarization separator to which the present invention is applied. The polarization separator includes a substantially tubular member 1. The tubular member has a circular waveguide 4 formed therein in which the orthogonal polarization waves propagate. The tubular member 1 has a flange 2 having a plurality of through-holes 3 formed therein. The tubular member 1 further has a rectangular opening 5 formed therein. The construction of the polarization separator described above is similar to that of the conventional polarization separator described hereinabove with reference to FIG. 1, and accordingly, further overlapping description of the common construction is omitted herein to avoid redundancy.

Figure 4B:
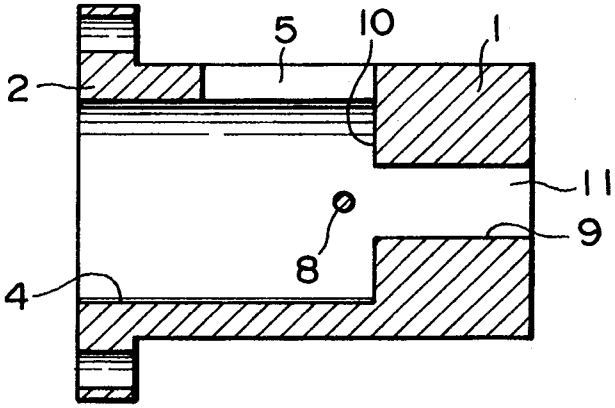
FIGS. 4A, 4B, 4C and 4D are a front elevational view, a side elevational sectional view, a top plan view and a rear elevational view, respectively, of the polarization separator shown in FIG. 3.
Figure 4C:
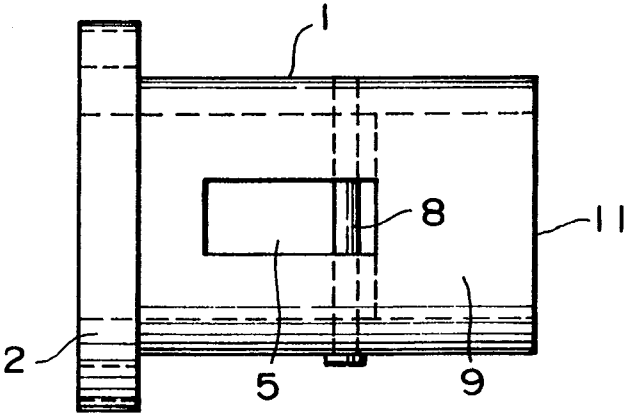
Figure 4A:
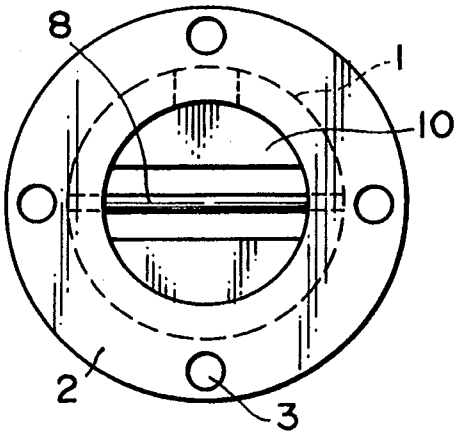
Figure 4D:
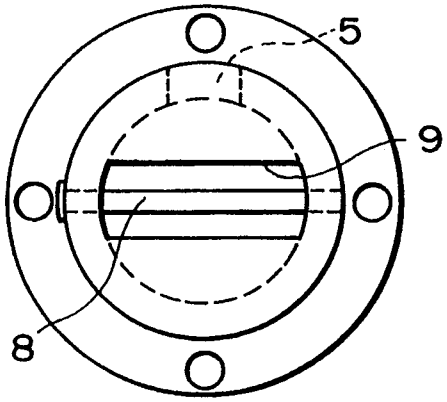

The polarization separator further includes a metal pole 8 for reflecting a horizontal polarization wave component H. The tubular member 1 further has a waveguide 9 formed therein by drawing upper and lower portions of the inner portion of the tubular member 1 so as to have a cross section of such a substantially rectangular shape as seen in FIG. 4D. The tubular member 1 further has an offset or step 10 for changing the circular inside section of the circular waveguide 4 into the rectangular inside section of the waveguide 9. The tubular member 1 has an output terminal 11 for extracting a vertical polarization wave component V therefrom.

Figure 3:
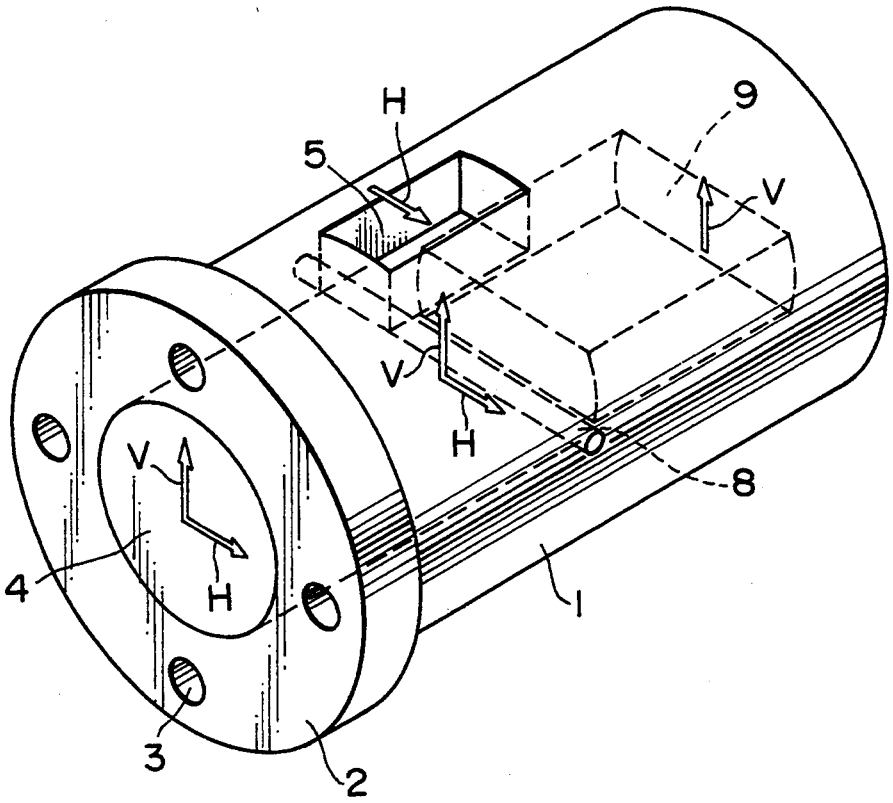
FIG. 3 is a perspective view of a polarization separator to which the present invention is applied.

It is to be noted that, in FIG. 3, arrow marks accompanied by characters H and V denote horizontal and vertical polarization wave components, respectively.

Figure 8:
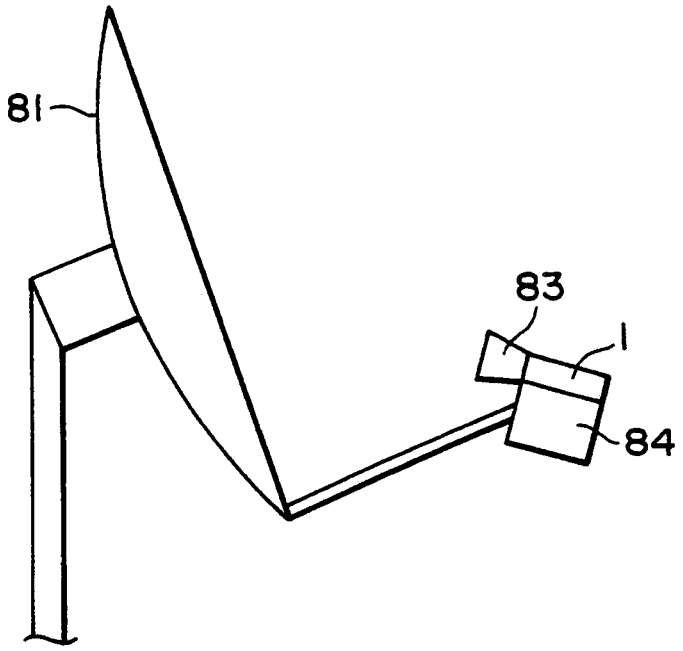
FIG. 8 PRIOR ART
FIG. 8 is a schematic view showing an antenna which can receive orthogonal polarization waves such as a CS signal reception antenna.

Orthogonal polarization waves received by a parabola antenna not shown are inputted as indicated orthogonal arrow marks in FIG. 3 into the circular waveguide 4 by way of a primary horn not shown (primary horn 83 shown in FIG. 8) and then propagate in the circular waveguide 4.

When the orthogonal polarization waves propagate to the metal pole 8 in the circular waveguide 4 as indicated by arrow marks in FIG. 3, since a horizontal polarization wave component H of the orthogonal polarization waves is parallel to the metal pole 8, it is reflected by the metal pole 8 so that it is thereafter outputted as indicated by an arrow mark from the output terminal 5 which is a rectangular opening having a major side in the direction of the axis of the tubular member 1.

Meanwhile, since a vertical polarization wave component V is perpendicular to the metal pole 8, it is not reflected by the metal pole 8 and consequently continues to propagate in the circular waveguide 4. Thus, the vertical polarization wave component V passes by the offset 10 and then propagates in the substantially rectangular waveguide 9 so that it is thereafter outputted as indicated by an arrow mark from the output terminal 11 of the tubular member 1.

Figure 9:
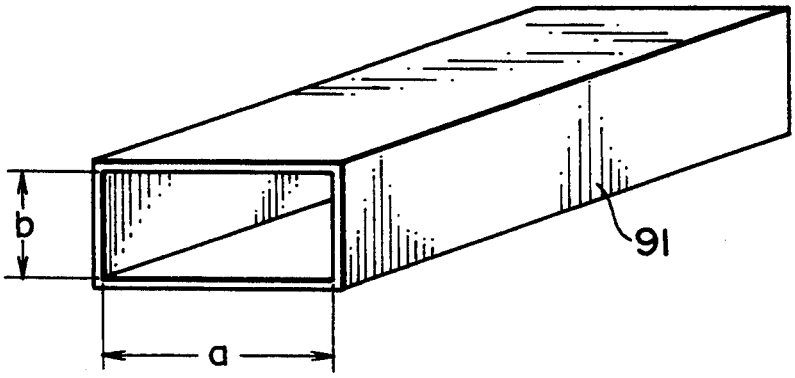
FIG. 9 PRIOR ART
FIG. 9 is a schematic perspective view showing a rectangular waveguide member.

It is to be noted that the cutoff frequency fc of a rectangular waveguide is given, where, as shown in FIG. 9, the width of the rectangular waveguide of a waveguide member 91 is represented by a, by the following equation (1):

$$fc=C/2a \quad (1)$$

where C is the velocity of light.

The width a of the substantially rectangular waveguide 9 of the tubular member 1 of the polarization separator shown in FIGS. 3 and 4A to 4D is set so that the frequency fv of the vertical polarization wave component may be higher than the cutoff frequency fc given by the equation (1) above.

Meanwhile, for the horizontal polarization wave component H, the cutoff frequency fc is calculated in accordance with the equation (1) with the width a substituted for b since the side of the length a of the waveguide 9 extends in parallel to the direction of the electric field of the horizontal polarization wave component H. Accordingly, the cutoff frequency fc of the waveguide 9 is high and the frequency fh of the horizontal polarization wave component H is lower than the cutoff frequency fc, and consequently, the horizontal polarization wave component H cannot propagate across the step 10 and accordingly will not leak to the output terminal 9 at all.

It is to be noted that the frequency fv of the vertical polarization wave component V and the frequency fh of the horizontal polarization wave component H in the waveguide are equal frequencies to each other of, for example, 12 GHz.

Where the waveguide 9 for introducing only the vertical polarization wave component V which is not reflected by the metal pole 8 is constructed in a cutoff structure for the horizontal polarization wave component H, the horizontal polarization wave component H can be reflected sufficiently not by such a long reflecting member having a considerable width as the reflection plate 6 but only by the metal pole 8.

In other words, in the polarization separator to which the present invention is applied, since the reflection means can be formed from an elongated bar-like metal pole, the circular waveguide 4 can be made short and the entire polarization separator 1 can be minimized.

It is to be noted that, while the location of the metal pole 8 must be a little rearwardly of the center as viewed from the opening of the output terminal 5, if the location of the metal pole 8 is adjusted finely or the size of the circular waveguide 4 is varied, then the frequency characteristic of the polarization separator varies, and accordingly, the location of the metal pole 8 should be determined so that a desired characteristic may be obtained taking them into account.

The metal pole 8 can be formed, for example, by screwing a long screw into the circular waveguide 4, which facilitates production and fixation of the reflection means.

Referring now to FIGS. 5 and 6A to 6C, there is shown another polarization separator to which the present invention is applied. The present polarization separator is a modification to the polarization separator described hereinabove with reference to FIGS. 3 and 4A to 4D, and only differences of it will be described while description of common components is omitted herein to avoid redundancy.

In the present polarization separator, an iris 12 is provided for restricting the opening of the output terminal 5 of the tubular member 1 for the horizontal polarization wave component H. The tubular member 1 is ground flat at an outer side portion thereof to form a flat face portion 13 which facilitates extraction of an output of the polarization separator. The waveguide 9 is bent at a corner 14 for reflecting the propagation direction of the vertical polarization wave component V in order to dispose an output terminal 15 for the vertical polarization wave component V on the same plane as the output terminal 5 for the horizontal polarization wave component H.

In the polarization separator described hereinabove with reference to FIGS. 3 and 4A to 4D, the opening of the output terminal 5 for the horizontal polarization wave component H is large, and due to the construction, the electric field of the vertical polarization wave component V is disordered in distribution at the location of the opening so that a reflected wave which returns to the input terminal is produced or an undesired polarization wave component leaks to the output terminal, resulting in obstruction to enhancement of the separation efficiency.

Therefore, in the polarization separator shown in FIGS. 5 and 6A to 6C, the iris 12 is provided in the opening of the output terminal 5, through which the horizontal polarization wave component H is outputted, to restrict the opening.

Figure 5:
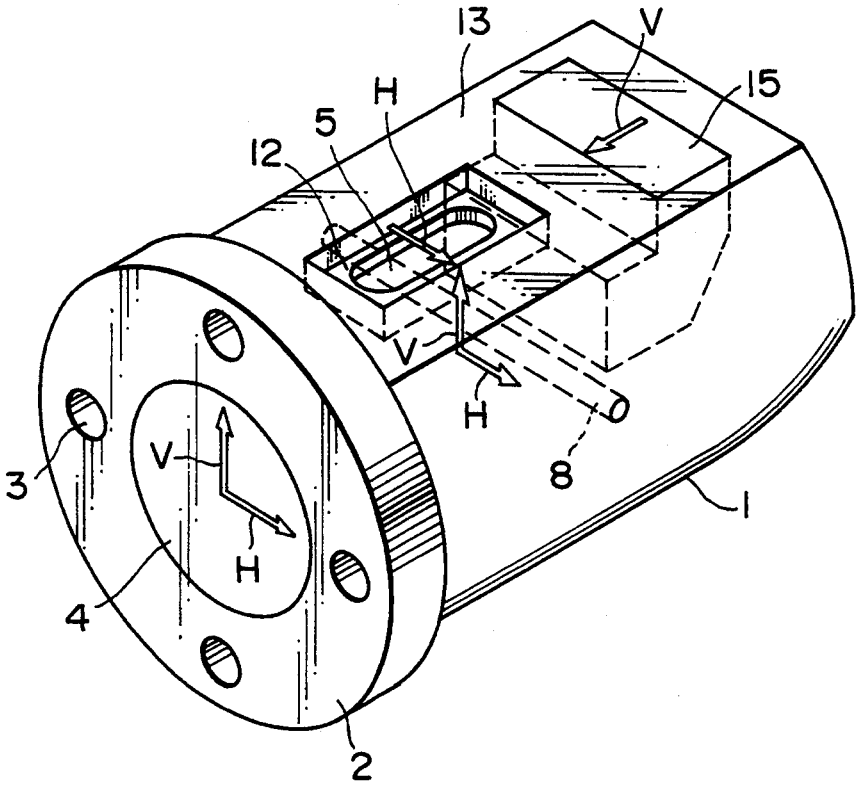
FIG. 5 is a perspective view of another polarization separator to which the present invention is applied.
Figure 6B:
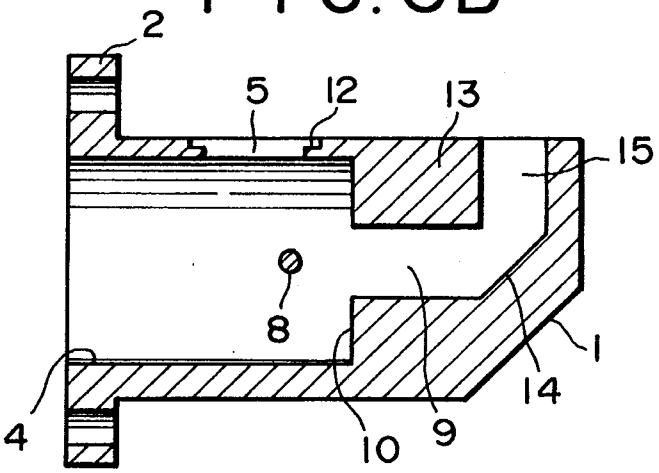
FIGS. 6A, 6B and 6C are a front elevational view, a side elevational sectional view and a top plan view, respectively, of the polarization separator shown in FIG. 5.
Figure 6C:
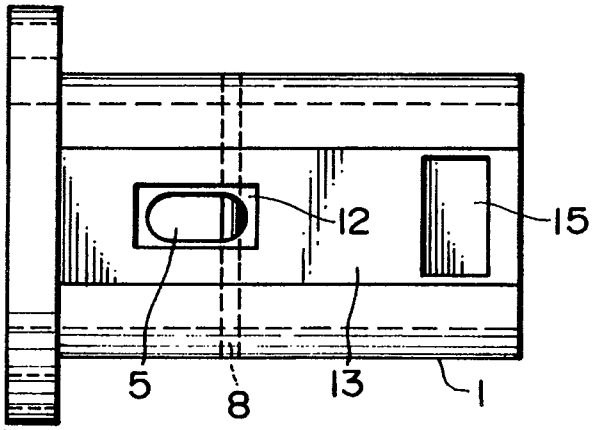
Figure 6A:
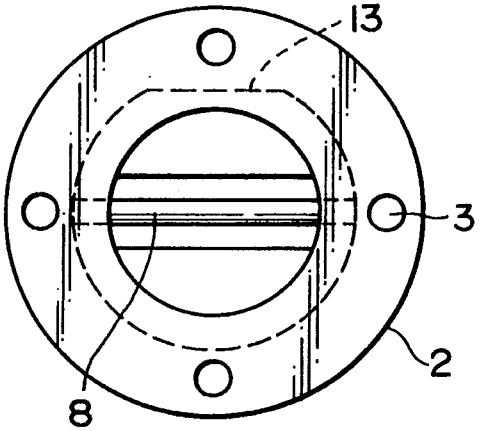

As seen in FIGS. 5 and 6A to 6C, the iris 12 has a substantially rectangular opening which is rounded at the opposite ends thereof so as to exhibit a generally elliptical shape as seen in FIG. 6C, and the area of the opening of the iris 12 is a little smaller than the area of the opening of the output terminal 5. Consequently, by locating the iris 12 in the opening of the output terminal 5, the opening area at the boundary between the output terminal 5 and the circular waveguide 4 is narrowed so that otherwise possible disorder of the electromagnetic field of the vertical polarization wave component V in the opening area of the output terminal 5 can be suppressed.

Further, in the polarization separator 1 shown in FIGS. 5 and 6A to 6C, the waveguide 9 for the vertical polarization wave component V is bent at the corner 14 thereof so as to bend the propagation direction of the vertical polarization wave component V upwardly so that the output terminal 15 for the vertical polarization wave component V is provided at the flat face portion 13 which is formed by grounding an outside portion of the tubular member 1 flat and lies in the same plane as the output terminal 5 for the horizontal polarization wave component H.

This construction allows outputs of the vertical polarization wave component V and the horizontal polarization wave component H to be extracted from the same plane, and consequently, extraction means for the horizontal polarization wave component H and the vertical polarization wave component V can be formed as a unitary member and placed on the flat face portion 13 of the circular waveguide 4. Accordingly, for example, it is easy to supply the outputs of the two polarization wave components to different function circuits provided on a common circuit board.

By the way, in the polarization separator 1 shown in FIGS. 5 and 6, since the iris 12 is provided, disorder of the electromagnetic field in the proximity of the opening from which the horizontal polarization wave component H is extracted can be prevented, but since the impedance varies suddenly at the location of the iris 12, it sometimes difficult to establish impedance matching with a circuit following the same.

Figure 7A:
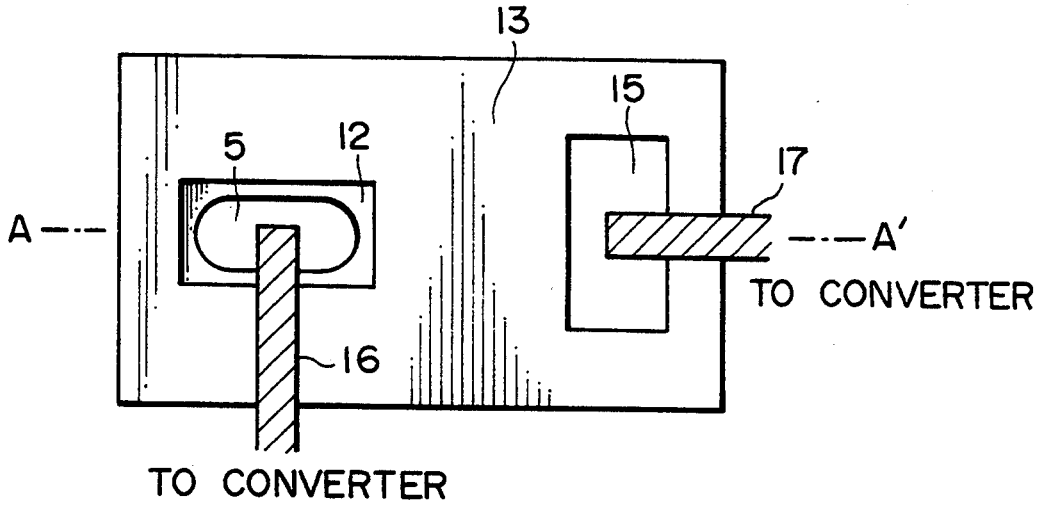
FIG. 7A is a top plan view of a further polarization separator to which the present invention is applied.
Figure 7B:
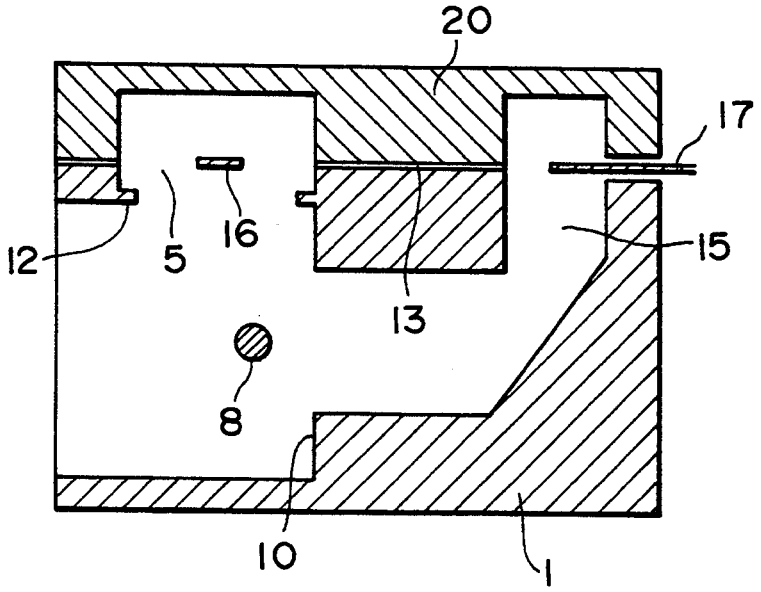
FIG. 7B is a sectional view taken along line A—A' of FIG. 7A

FIGS. 7A and 7B show a waveguide-microstrip line mode transformer which is a modification to the waveguide-microstrip line mode transformer described above with reference to FIGS. 6A to 6C and is modified such that impedance matching can be established readily while the iris 12 is provided. Thus, only differences of it will be described while description of common components is omitted herein to avoid redundancy.

Referring to FIGS. 7A and 7B, the waveguide-microstrip line mode transformer shown additionally includes a probe 16 disposed in the proximity of the iris 12 and formed from a microstrip line for extracting and supplying a horizontal polarization wave component H to the converter 84 (FIG. 8), another probe 17 disposed in the proximity of the output terminal 11 and formed from another microstrip line for extracting and supplying a vertical polarization wave component V, and a metal lid member 20 placed on the flat face portion 13, on which the output terminals 5 and 11 of the polarization separator 1 are provided, and having hollows formed on a face thereof opposing to the flat face portion 13 for defining spaces from which the horizontal polarization wave component H and the vertical polarization wave component V are extracted.

It is to be noted that FIG. 7A shows the flat face portion 13 with the lid member 20 removed, and FIG. 7B is a sectional view taken along line A—A' of the polarization separator 1 shown in FIG. 7A.

In the waveguide-microstrip line mode transformer shown in FIGS. 7A and 7B, the horizontal polarization wave component H reflected by the metal pole 8 propagates through the iris 12 to the output terminal 5. The horizontal polarization wave component H then propagates in a space defined by the output terminal 5 and one of the hollows of the lid member 20 and is received by the probe 16 which is located in the space.

The probe 16 is constituted from part of the microstrip line of the converter 84 described hereinabove, and consequently, the horizontal polarization wave component H received by the probe 16 is supplied from the probe 16 to the converter 84 by way of the microstrip line.

The input impedance to the converter 84 can be adjusted readily by varying the configuration of the probe 16. Accordingly, by employing such probe 16, impedance matching between the waveguide and the converter 84 can be established readily.

It is to be noted that the vertical polarization wave component V propagates along the corner 14 of the waveguide 9 and is outputted from the output terminal 15, whereafter it is received by the other probe 17 located in the other space defined by the output terminal 15 and the other hollow of the lid member 20 and is then supplied to another input terminal of the converter 84.

Figure 10:
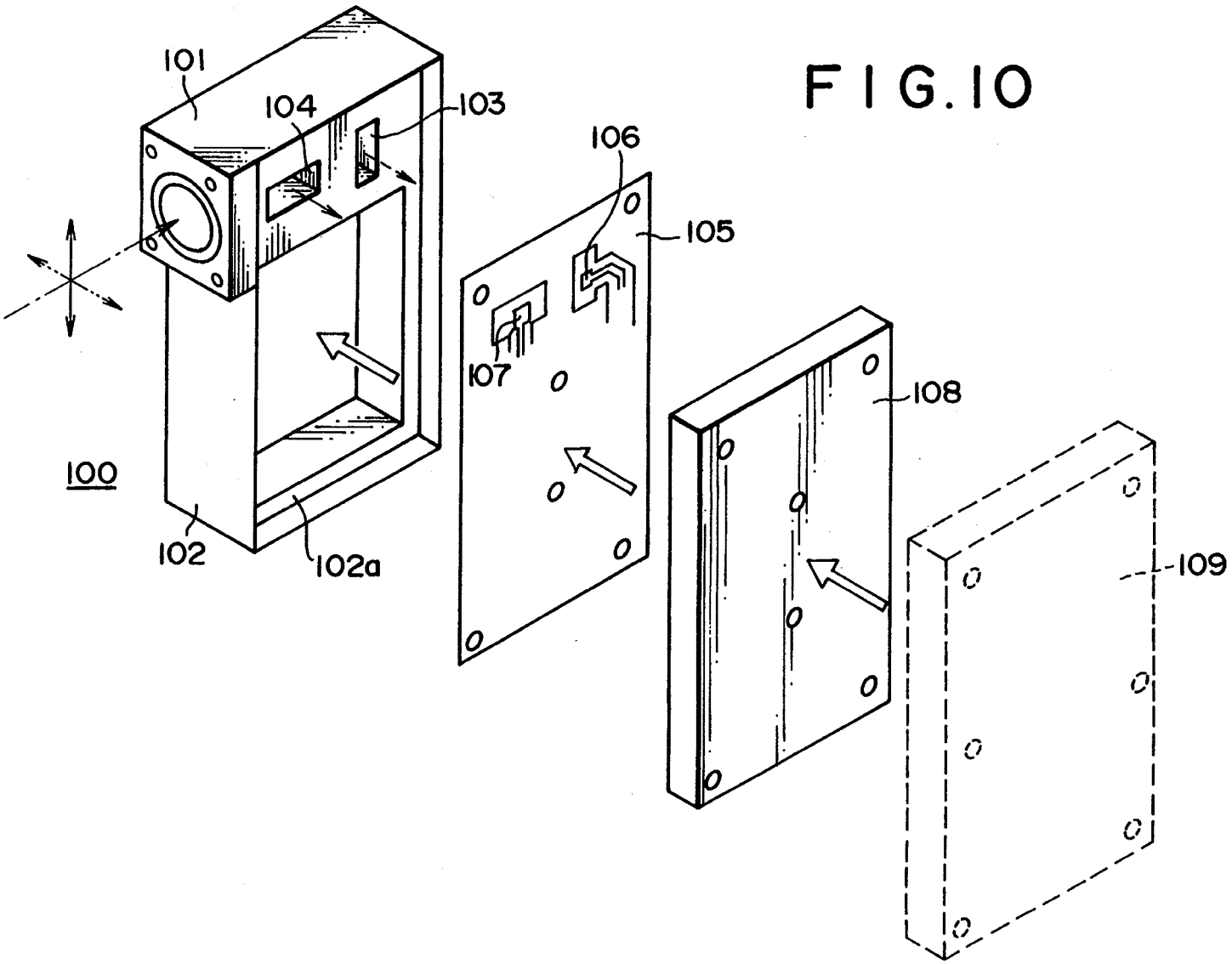
FIG. 10 is an exploded view of a case of a converter to which the present invention is applied.

Referring now to FIG. 10, there is shown a structure according to the present invention wherein a polarization separator and a shield case of a converter are formed as a unitary member.

The converter is generally denoted at 100 while the polarization separator is generally denoted at 101. The polarization separator 101 separates orthogonal polarization waves received by a parabola antenna not shown in FIG. 10 into vertical polarization waves and horizontal polarization waves. A shield case 102 is provided for shielding such circuits as amplifiers and mixers mounted on a circuit board 105. The polarization separator 101 includes a rectangular waveguide 103 having an end portion from which separated horizontal polarization waves H are outputted and another rectangular waveguide 104 having an end portion from which separated vertical polarization waves are outputted. The circuit board 105 further has a probe 106 for receiving horizontal polarization waves and another probe 107 for receiving vertical polarization waves. A shield cover 108 serves as a lid for the shield case 100, and a waterproof case 109 is used to protect the elements in the shield case 100 from water.

As seen in FIG. 10, the converter 100 is formed as a unitary member by molding of a metal such as aluminum and including the shield case 102 and the polarization separator 101, and orthogonal polarization waves including a horizontal polarization wave component and a vertical polarization wave component are introduced into the polarization separator 101. The horizontal polarization wave component separated by the polarization separator 101 is outputted from the waveguide 103 while the separated vertical polarization wave component is outputted from the waveguide 104.

A stepped portion 102*a* is formed on an inner circumferential face of the shield case 102, and the circuit board 105 is mounted as indicated by an arrow mark in FIG. 10 such that peripheral portions of the circuit board 105 are received by the stepped portion 102*a*.

The circuit board 105 is constituted from a double-sided printed circuit board formed from, for example, a glass epoxy resin plate. The probe 106 for extracting horizontal polarization waves, the other probe 107 for extracting vertical polarization waves, amplifiers, mixers and various other electric circuits are incorporated in the printed circuit board and connected to each other by way of microstrip lines. When the circuit board 105 are placed in position on the stepped portion 102*a* of the shield case 102, the probes 106 and 107 provided on the circuit board 105 are positioned at end portions of the waveguides 103 and 104, respectively.

If the circuit board 105 is mounted onto the shield case 102 and then the shield case 102 is covered with the shield cover 108 as indicated by an arrow mark in FIG. 10, then the end portions of the waveguides 103 and 104 are terminated by respective hollows formed on the shield cover 108 while the circuit board 105 is held between and fixed by the end portions of the waveguides 103 and 104 and the shield cover 108. Further, since the circuit board 105 is accommodated in a space defined by and between the shield case 102 and the shield cover 108, it is electromagnetically shielded and will not allow leakage of disturbing waves.

Meanwhile, when it is intended to protect the converter 100 from water, the shield cover 108 should be covered with the waterproof case 109.

Figure 11:
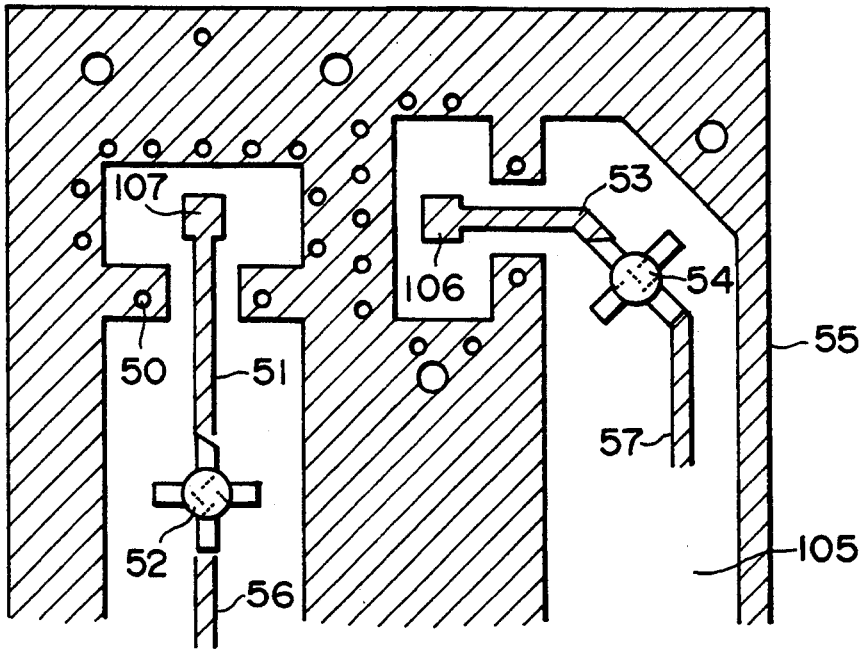
FIG. 11 is a schematic view showing a circuit board of the converter shown in FIG. 10.

An example of the circuit board 105 is shown in FIG. 11. Referring to FIG. 11, the probes 106 and 107 are formed from printed wires on the circuit board 105, and also microstrip lines 51, 53, 56 and 57 are formed from printed wires on the circuit board 105. Amplifier FETs (field effect transistors) 52 and 54 are soldered to the microstrip lines 51, 53, 56 and 57. The probe 106 receives horizontal polarization waves from an end portion of the waveguide 103, and the other probe 107 receives vertical polarization waves from an end portion of the waveguide 104. A plurality of through-holes 50 are formed for a grounding line 55 around the probes 106 and 107. A vertical polarization signal propagates in the microstrip lines 51 and 56 and is amplified by the FET 52 while a horizontal polarization signal propagates in the microstrip lines 53 and 57 and is amplified by the FET 54.

In the circuit board 105 shown in FIG. 11, a horizontal polarization signal received by the probe 106 located at the end portion of the waveguide 103 propagates in the microstrip line 53 and is then amplified by the FET 54, whereafter it is outputted to the microstrip line 57 connected to a mixer not shown. Then, the frequency of the horizontal polarization signal is converted by down conversion into a signal of an intermediate frequency.

Meanwhile, a vertical signal received by the probe 107 located at the end portion of the waveguide 104 propagates in the microstrip line 51 and is then amplified by the FET 52, whereafter it is outputted to the microstrip line 56 connected to another mixer not shown. Then, the frequency of the vertical polarization wave component is converted by down conversion into a signal of an intermediate frequency.

The through-holes 50 perforated around the probes 106 and 107 connect a grounding line on the front face and another grounding line on the rear face of the printed circuit board 105 to each other. The through-holes 50 are arranged such that they surround printed wiring portions blanked in substantially same shapes as the shapes of cross sections of the waveguides 103 and 104 so that vertical and horizontal polarization signals may not leak from the locations.

Preferably, the distance between the through-holes 50 is set so that it may be smaller than a cutoff frequency of electromagnetic waves outputted from the waveguides 103 and 104.

Where the through-holes 50 are provided in this manner, the characteristic of the waveguide-microstrip line mode transformer can be improved as hereinafter described.

Figure 12A:
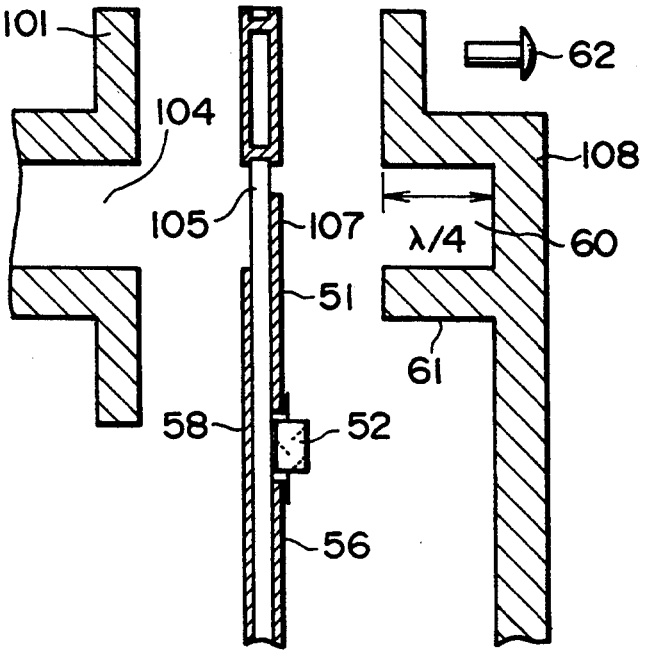
FIGS. 12A and 12B are sectional views showing the converter of FIG. 10 before and after a polarization separator is assembled to the converter, respectively.
Figure 12B:
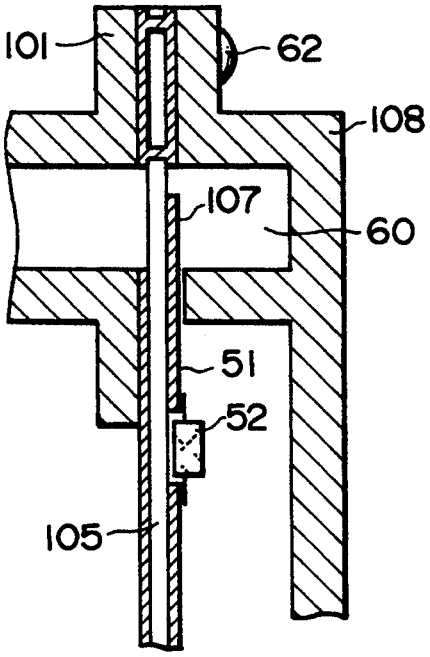

Referring now to FIGS. 12A and 12B, the circuit board 105 is shown held between the polarization separator 101 provided integrally on the shield case 102 and the shield cover 108. In particular, FIG. 12A shows in cross sectional view an arrangement of the circuit board 105 disposed in an opposing relationship to the end portion of the waveguide 104 and the shield case 108 disposed in an opposing relationship to the circuit board 105, and FIG. 12B shows the circuit board 105 held between and fixed by the end portion of the waveguide 104 and the shield case 108.

The shield cover 108 has a hollow 60 formed thereon for terminating the waveguide 104. The hollow 60 has a depth of $\lambda/4$ and is defined by a projection 61 formed on the shield cover 108. The circuit board 105 is held between and fixed by the polarization separator 101 and the shield cover 108, which are fastened together by means of a plurality of machine screws 62. It is to be noted that a grounding pattern 58 is formed on the rear face of the circuit board 105.

In assembly, the polarization separator 101, the circuit board 105 and the shield case 108 are disposed in such a condition as shown in FIG. 12A and then contacted with each other, and then the machine screws 62 are screwed to fasten the shield case 108 to the polarization separator 101. Consequently, the circuit board 105 is held between and fixed by the polarization separator 101 and the shield case 108 as shown in FIG. 12B.

In the construction shown in FIG. 12B, since the end portion of the waveguide 104 of the polarization separator 101 is terminated by the hollow 60 of the depth of $\lambda/4$ of the shield case 108, a signal of a vertical polarization wave component can be extracted efficiently from the probe 107. The signal of the vertical polarization wave component propagates in the microstrip line 51 and is inputted to the FET 52. Consequently, the signal of the vertical polarization wave component is amplified by and outputted from the FET 52 to the microstrip line 56.

Meanwhile, though not shown, a signal of a horizontal polarization wave component is received by the probe 106, amplified by the FET 54 and outputted to the microstrip line 57 similarly to the signal of the vertical polarization wave component.

Where the polarization separator 101 is molded integrally with the shield case 102 of the converter 100 and the shield cover 108 is mounted as a lid member on the shield case 102 in this manner, the waveguide-microstrip line mode transformer can be constructed readily and minimized in loss. Further, the converter 100 is superior in cross polar characteristic.

Figure 13A:
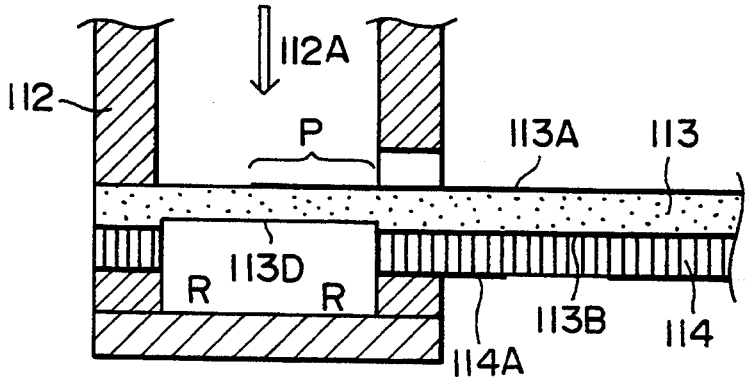
FIGS. 13A and 13B are a sectional view and a plan view, respectively, of a waveguide-microstrip line mode transformer to which the present invention is applied.
Figure 13B:
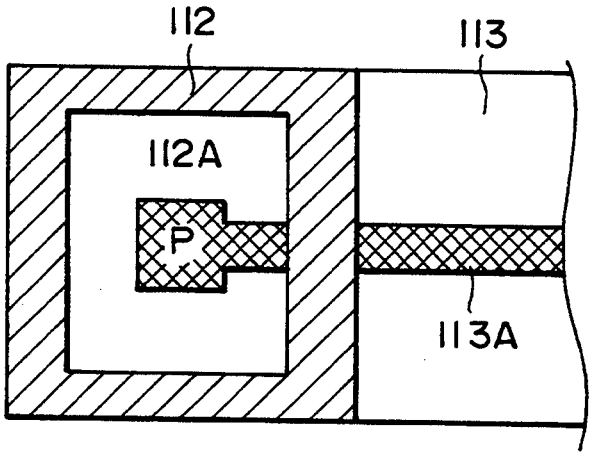

Referring now to FIGS. 13A and 13B, there is shown in sectional view and plan view a waveguide-microstrip line mode transformer applied to a converter according to the present invention. A waveguide member 112 is shown in section and has an internal space or waveguide 112A in which electromagnetic waves in the form of horizontally polarization waves or vertical polarization waves are present.

A circuit board on which MIC parts are mounted is formed as a multi-layer circuit board including a first circuit board 113 made of Teflon or a like material and a second circuit board 114 formed from a glass epoxy resin plate as seen in FIG. 13B.

A center conductor 113A is formed on a surface of the first circuit board 113 and has an end portion which serves as a probe P. The probe P extends into the inside of the waveguide member 112 so that electromagnetic waves may be extracted into the microstrip line.

Grounding conductors 113B and 114A and a portion of the second circuit board 114 are removed from a portion of the multi-layer circuit board located in the space 112A, and a corresponding portion of the first circuit board 113 is fixed in a sandwiched condition in portions of opposing side walls of the waveguide member 112.

Electroplating is applied in advance to end faces R of the circuit boards 113 and 114 which face the inside of the waveguide member 112 so that electromagnetic waves may be intercepted from leaking to the outside through the portions.

Consequently, a microwave signal can be prevented from leaking from the transformer portion from which the output of the waveguide member 112 is extracted into the microstrip line formed on the multi-layer circuit board from which the converter is formed.

Figure 14:
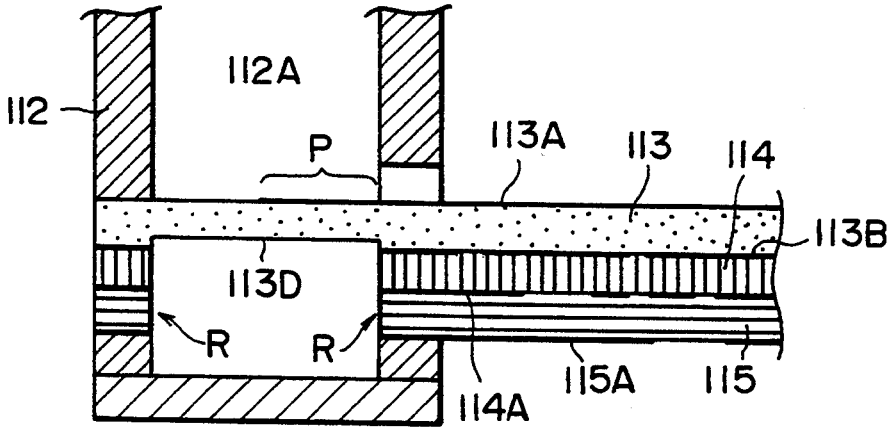
FIG. 14 is a sectional view of another waveguide-microstrip line mode transformer to which the present invention is applied.

While the waveguide-microstrip line mode transformer is described constructed such that the multi-layer circuit board is formed as a two-layer circuit board, a modified waveguide-microstrip line mode transformer wherein the multi-layer circuit board is formed as a three-layer circuit board is shown in FIG. 14.

Referring to FIG. 14, the multi-layer circuit board of the modified waveguide-microstrip line mode transformer includes an additional circuit board 115 forming a third layer.

Also in the present waveguide-microstrip line mode transformer, portions of the grounding conductors 113B, 114A and 115A of the circuit boards 113, 114 and 115 and portions of the second and third circuit boards 114 and 115 which are located in the inside of the waveguide member 112 are removed, and end faces R of the second and third circuit boards 114 and 115 which are produced in the inside of the waveguide member 112 as a result of such removal are plated by electroplating to form conductive layers.

While electroplating is applied to the end faces of the circuit boards in the inside of the waveguide member of the waveguide-microstrip line mode transformer described above, alternatively through-holes may be perforated at portions adjacent the end faces R of the circuit boards in the inside of the waveguide member 112 to prevent leakage of electromagnetic waves.

Figure 15A:
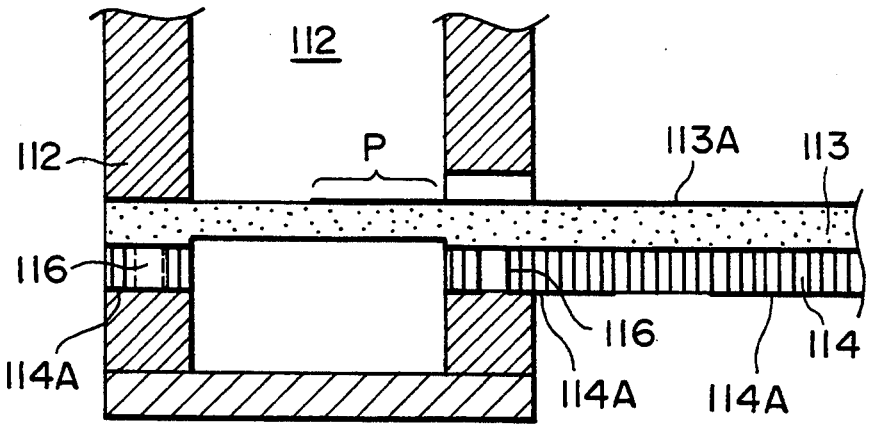
FIGS. 15A and 15B are a sectional view and a plan view, respectively, of a further waveguide-microstrip line mode transformer to which the present invention is applied.
Figure 15B:
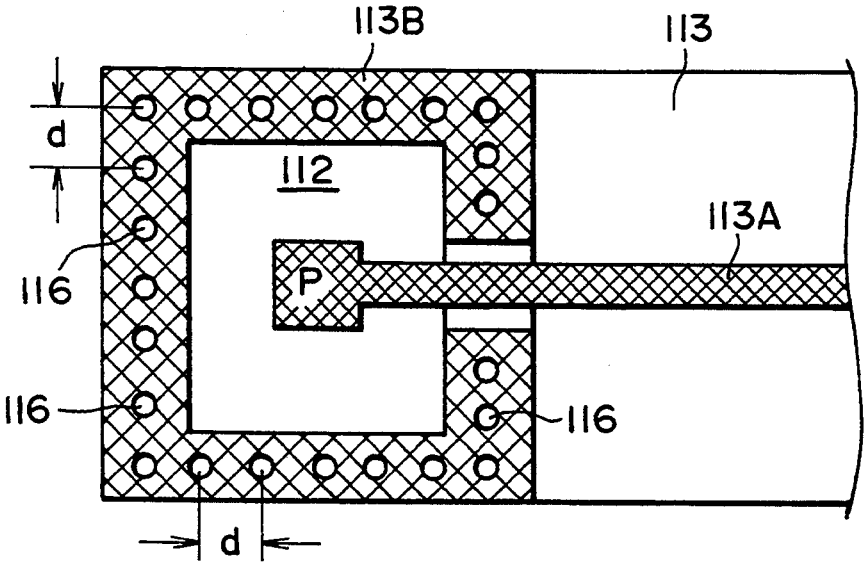

FIGS. 15A and 15B show another modification to the waveguide-microstrip line mode transformer. The modified waveguide-microstrip line mode transformer is constructed such that leakage of electromagnetic waves is prevented by means of through-holes in place of an electroplated layer.

In particular, a plurality of through-holes 116 are perforated in the first circuit board 113 and the second circuit board 114 and short-circuit the grounding conductor 113B of the first circuit board 113 and the grounding conductor 114A of the second circuit board 114. The through-holes 116 are disposed in an aligned condition with a center line of the side wall of the waveguide member 112 shown in FIG. 15B.

Preferably, the distance d between the through-holes 116 is set smaller than a cutoff wavelength of electromagnetic waves to be introduced into the inside of the waveguide member 112.

In the present waveguide-microstrip line mode transformer, the through-holes are formed upon production of the multi-layer circuit board, and then in the process of mounting MIC parts onto the multi-layer circuit board, the grounding conductors on the first and second circuit boards are short-circuited by way of the through-holes 117. Consequently, an operation of performing electroplating can be omitted.

Figure 16A:
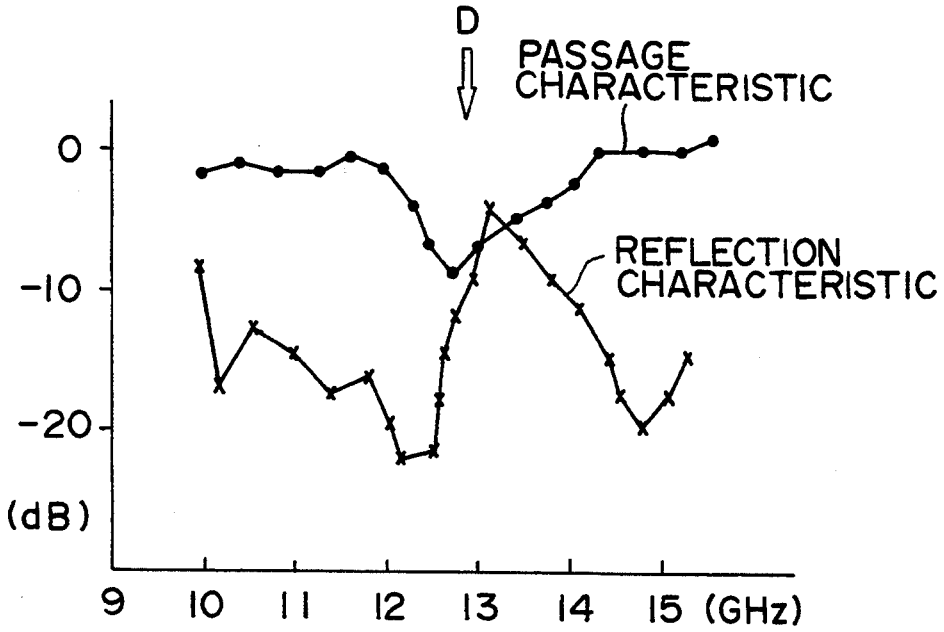
FIGS. 16A and 16B are diagrams showing characteristics of a transformation signal when an end face of a circuit board in the inside of a waveguide has a plated layer formed thereon and has through-holes formed therein, respectively.
Figure 16B:
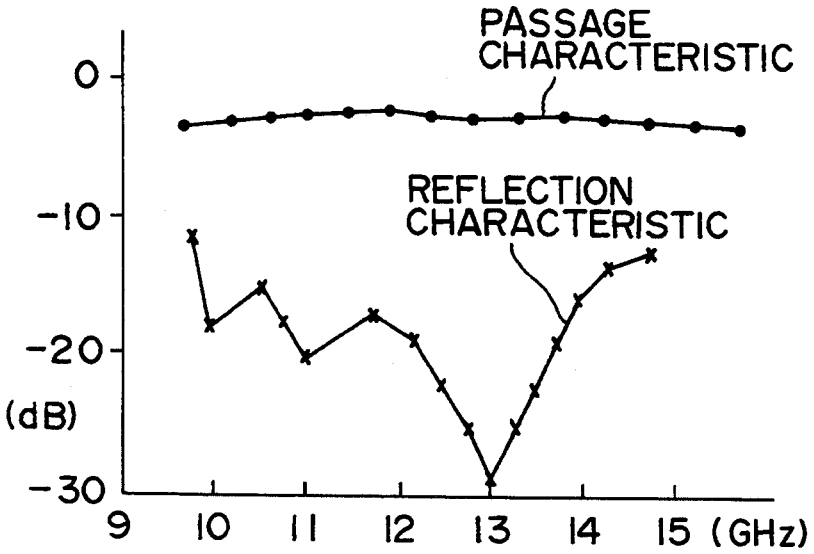
Figure 17:
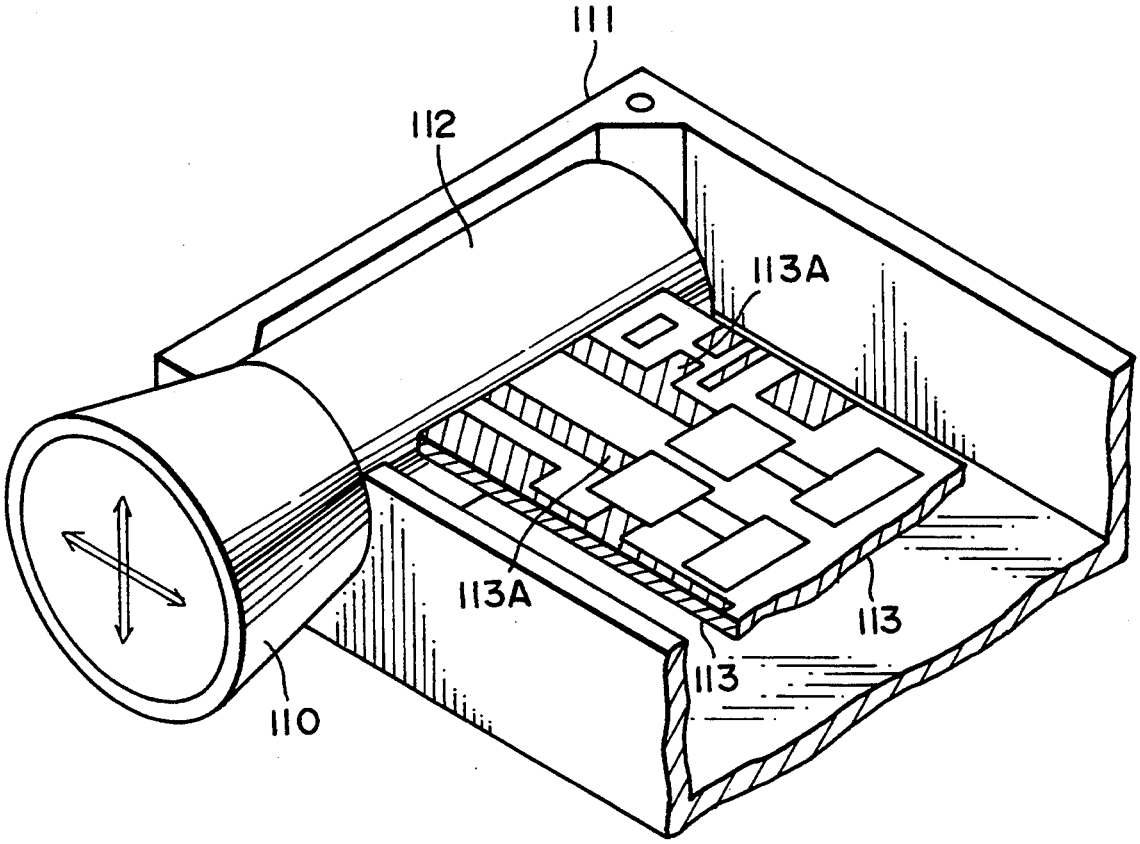
FIG. 17 PRIOR ART
FIG. 17 is a schematic perspective view of part of a converter for converting reception radio waves of a parabola antenna by down conversion.
Figure 18:
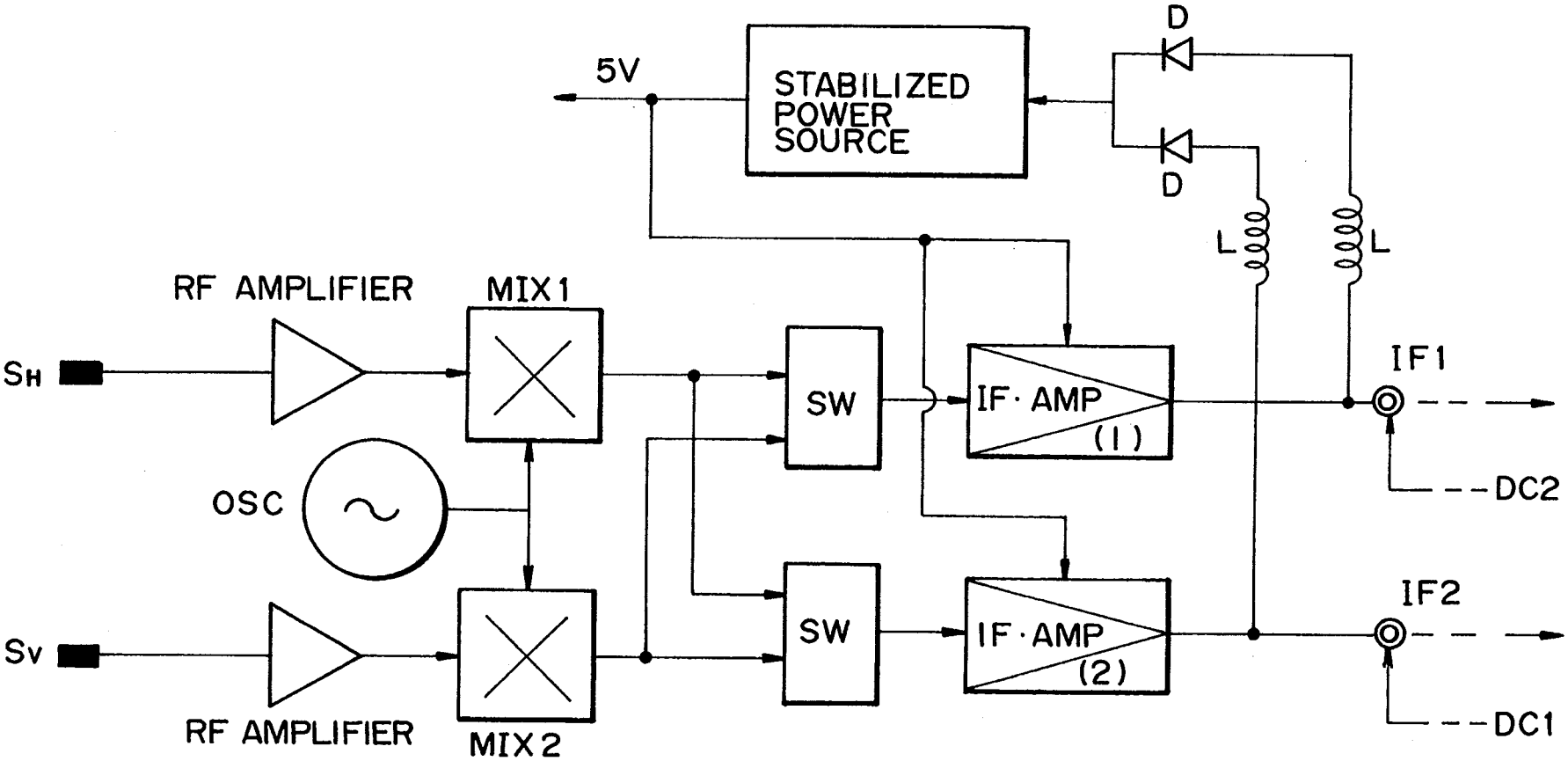
FIG. 18 is a block diagram of a signal circuit system of a converter.
Figure 19A:
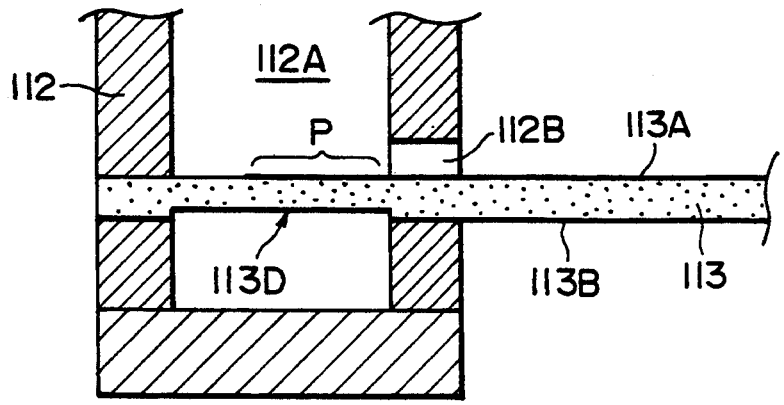
FIG. 19A PRIOR ART
FIGS. 19A and 19B are a sectional view and a top plan view, respectively, of a conventional waveguide-microstrip line mode transformer formed from a single layer circuit board.
Figure 19B:
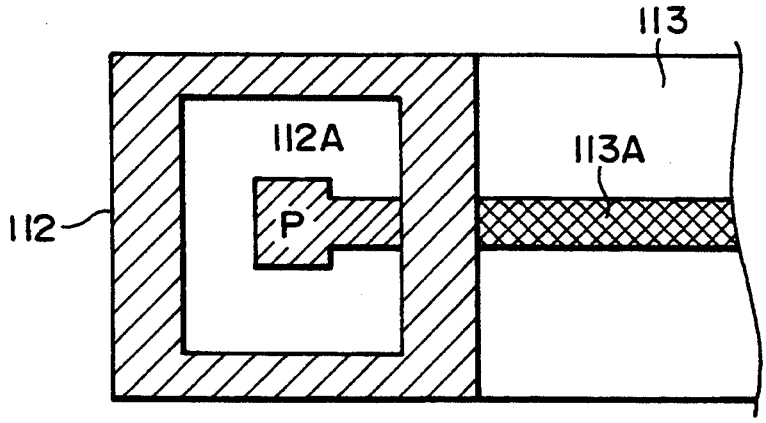
FIG. 19B PRIOR ART
Figure 20:
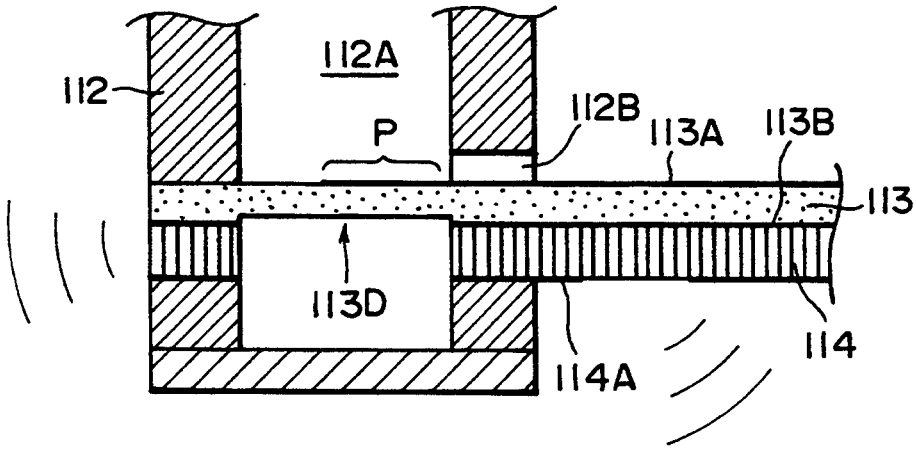
FIG. 20 PRIOR ART
FIG. 20 is a sectional view of another conventional waveguide-microstrip line mode transformer formed from a multi-layer circuit board.

FIGS. 16A and 16B illustrate the transformation characteristics of waveguide-microstrip line mode transformers. In particular, FIG. 16A illustrates the transformation characteristic of a waveguide-microstrip line mode transformer wherein such through-holes as described above are formed in a portion of the multi-layer circuit board aligned with the side wall of the waveguide, and FIG. 16B illustrates the transformation characteristic of another waveguide-microstrip line mode transformer wherein such through-holes are not formed.

Where through-holes are not formed, the passage characteristic exhibits a degradation at the frequency of 12 to 13 GHz as seen from FIG. 16A, but where such through-holes are formed, the passage characteristic is improved as seen from FIG. 16B.

Having now fully described the invention, it will be apparent to one of ordinary skill in the art that many changes and modifications can be made thereto without departing from the spirit and scope of the invention as set forth herein.

What is claimed is:

1. A polarization separator for a microwave apparatus comprising:

a substantially tubular member having a circular waveguide formed therein for receiving input orthogonal polarization electromagnetic waves, a first rectangular hole formed in a side wall thereof, a second rectangular hole formed in a same plane in the same side wall thereof, and a rectangular waveguide formed therein and extending between said circular waveguide and said second rectangular hole;

a reflecting pole located in said circular waveguide and having an axis extending perpendicularly to a direction in which the input orthogonal polarization electromagnetic waves propagate and also to a direction of a line along which said first rectangular hole and the center of said circular waveguide lie;

dimensions of height and width of said rectangular waveguide are determined such that said rectangular waveguide has a cutoff frequency higher than that of a first one of the input orthogonal polarization electromagnetic waves but lower than that of a second one of the input orthogonal polarization electromagnetic waves; and a reflecting face for changing the direction of propagation of the second electromagnetic wave in said rectangular waveguide approximately by 90 degrees in said rectangular waveguide is formed in said rectangular waveguide.

2. A microwave apparatus, comprising:

a substantially tubular member having a circular waveguide formed therein for receiving input orthogonal polarization electromagnetic waves, a first rectangular hole formed in a side wall thereof, a second rectangular hole formed in a same plane in the same side wall thereof, and a rectangular waveguide formed therein and extending between said circular waveguide and said second rectangular hole;

a reflecting pole located in said circular waveguide and having an axis extending perpendicularly to a direction in which the input orthogonal polarization electromagnetic waves propagate and also to a direction of a line along which said first rectangular hole and the center of said circular waveguide lie;

said tubular member and said reflecting pole constituting a polarization separator;

a circuit board;

a pair of waveguide-microstrip line mode transformers located on said circuit board corresponding to locations of said first and second rectangular holes; and a cover for covering over said first and second rectangular holes and holding said circuit board thereon.

3. A microwave apparatus as claimed in claim 2, further comprising a shield case for covering over said polarization separator as well as an electric circuit on said circuit board including said waveguide-microstrip line mode transformers, and a waterproof case for covering said shield case and said cover.

4. A microwave apparatus as claimed in claim 2, wherein said cover has a pair of hollows formed thereon corresponding to said first and second rectangular holes.

5. A microwave apparatus as claimed in claim 4, wherein said hollows of said cover have a depth substantially equal to one fourth of a wavelength of the input electromagnetic waves.

* * * * *